US010199010B2

(12) United States Patent
Qiao et al.

(10) Patent No.: US 10,199,010 B2
(45) Date of Patent: Feb. 5, 2019

(54) DISPLAY DRIVING SYSTEM AND DISPLAY APPARATUS

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Chunying Qiao, Beijing (CN); Liqiang Yu, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/521,884

(22) PCT Filed: May 4, 2016

(86) PCT No.: PCT/CN2016/080972
§ 371 (c)(1),
(2) Date: Apr. 25, 2017

(87) PCT Pub. No.: WO2017/140035
PCT Pub. Date: Aug. 24, 2017

(65) Prior Publication Data

US 2018/0122330 A1 May 3, 2018

(30) Foreign Application Priority Data

Feb. 19, 2016 (CN) ..... 2016 1 0094997

(51) Int. Cl.
*G09G 5/02* (2006.01)
*G09G 3/36* (2006.01)
*G09G 5/10* (2006.01)

(52) U.S. Cl.
CPC ..... *G09G 5/02* (2013.01); *G09G 3/3648* (2013.01); *G09G 5/10* (2013.01); *G09G 2320/02* (2013.01);
(Continued)

(58) Field of Classification Search
CPC ..... G09G 5/02; G09G 5/10; G09G 3/3648; G09G 2320/02
See application file for complete search history.

(56) References Cited

U.S. PATENT DOCUMENTS

2015/0161933 A1 6/2015 Wu

FOREIGN PATENT DOCUMENTS

CN 104299560 A 1/2015
CN 104335144 A 2/2015
(Continued)

OTHER PUBLICATIONS

International Search Report and Written Opinion (including English translation of Box V.) dated Nov. 25, 2016, for corresponding PCT Application No. PCT/CN2016/080972.
(Continued)

*Primary Examiner* — Michael Pervan
(74) *Attorney, Agent, or Firm* — Kinney & Lange, P.A.

(57) ABSTRACT

The embodiments of the present disclosure provide a display driving system and a display apparatus. The display driving system comprises: a voltage adjustment circuit comprising an analog display signal input terminal, a trigger signal input terminal and an analog display signal output terminal. The voltage adjustment circuit is configured to adjust a blue voltage signal inputted to the analog display signal input terminal, in response to an adjustment trigger signal inputted to the trigger signal input terminal, to lower a light emission brightness corresponding to the blue voltage signal, and output the adjusted blue voltage signal via the analog display
(Continued)

signal output terminal. In the display driving system, the adjustment trigger signal is inputted to the trigger signal input terminal and the blue voltage signal inputted to the analog display signal input terminal is adjusted, such that the blue voltage signal outputted from the analog display signal output terminal has a reduced amplitude.

19 Claims, 3 Drawing Sheets

(52) U.S. Cl.
CPC ..... *G09G 2320/0666* (2013.01); *G09G 2360/144* (2013.01)

(56) References Cited

FOREIGN PATENT DOCUMENTS

| | | | |
|---|---|---|---|
| CN | 104715701 | A | 6/2015 |
| CN | 105246223 | A | 1/2016 |
| CN | 105590578 | A | 5/2016 |

OTHER PUBLICATIONS

First Chinese Office Action, for Chinese Patent Application No. 201610094997.0, dated Nov. 29, 2017, 12 pages.

Diagram of RGB Spectra

DISPLAY DRIVING SYSTEM AND DISPLAY APPARATUS

CROSS-REFERENCE TO RELATED APPLICATIONS

The present disclosure corresponds to PCT/CN2016/080972, which claims a benefit from Chinese Patent Application No. 201610094997.0 filed on Feb. 19, 2016, which is incorporated here by reference in its entirety.

TECHNICAL FIELD

The present disclosure relates to display technology, and more particularly, to a display driving system and a display apparatus.

BACKGROUND

Conventionally, a backlight source used in a Liquid Crystal Display (LCD) apparatus has a spectrum containing a large amount of high-energy short-wave blue lights at various irregular frequencies. As shown in FIG. 1, the wavelengths of visible light range from 380 nm to 780 nm, among which the wavelengths of blue light lie mainly between 430 nm and 450 nm. Blue light also contains a portion of ultraviolet light. As shown in FIG. 2, ultraviolet light will penetrate the cornea and lends and reach the retina, which will accelerate oxidation of cells in the macular area of the retina. Excessive radiation of ultraviolet light may cause damage to visual cells and thus the eyes.

SUMMARY

According to the embodiments of the present disclosure, a display driving system and a display apparatus are provided.

In a first aspect of the embodiments of the present disclosure, a display driving system is provided. The display driving system comprises: a voltage adjustment circuit comprising an analog display signal input terminal, a trigger signal input terminal and an analog display signal output terminal. The voltage adjustment circuit is configured to adjust a blue voltage signal inputted to the analog display signal input terminal, in response to an adjustment trigger signal inputted to the trigger signal input terminal, to lower a light emission brightness corresponding to the blue voltage signal, and output the adjusted blue voltage signal via the analog display signal output terminal.

In an embodiment, the voltage adjustment circuit comprises a plurality of trigger signal input terminals and is adapted to adjust the blue voltage signal inputted to the analog display signal input terminal, in response to respective adjustment trigger signals inputted to the respective trigger signal input terminals, to lower the light emission brightness corresponding to the blue voltage signal by respective different ratios.

In an embodiment, the display driving system further comprises: an adjustment switch connected to the voltage adjustment circuit and adapted to output, when triggered by a user, the adjustment trigger signal(s) to the trigger signal input terminal(s) of the voltage adjustment circuit.

In an embodiment, the adjustment switch is configured to output the respective adjustment trigger signals to the respective trigger signal input terminals of the voltage adjustment circuit in response to a trigger instruction from the user.

In an embodiment, the display driving system further comprises: a light sensing unit adapted to determine whether an intensity of ambient light reaches an adjustment threshold and, if so, output the adjustment trigger signal(s) to the trigger signal input terminal(s) of the voltage adjustment circuit.

In an embodiment, the light sensing unit is configured to output the respective adjustment trigger signals to the respective trigger signal input terminals of the voltage adjustment circuit when the intensity of the ambient light reaches respective different adjustment thresholds.

In an embodiment, the light sensing unit comprises a light sensor and a logic circuit configured to generate the adjustment trigger signal(s) based on a light intensity signal collected by the light sensor.

In an embodiment, the light sensing unit further includes an amplifier configured to amplify the light intensity signal collected by the light sensor. The logic circuit is configured to generate the adjustment trigger signal(s) based on the amplified light intensity signal.

In an embodiment, the voltage adjustment circuit comprises at least one adjustment unit connected in series between the analog display signal input terminal and the analog display signal output terminal corresponding to the blue voltage signal. The number of the adjustment units equals the number of the trigger signal input terminals and each of the adjustment units corresponds to one of the trigger signal input terminals. Each of the adjustment units comprises a resistor and a control switch connected in parallel to the resistor, the control switch having a control terminal connected to the corresponding trigger signal input terminal.

In an embodiment, the display driving system further comprises: a Direct Circuit (DC) low voltage terminal. The voltage adjustment circuit further comprises at least one ground resistor having one end connected to the DC low voltage terminal and the other end to one trigger signal input terminal.

In an embodiment, the display driving system further comprises: an Analog-to-Digital Converter (ADC) circuit configured to convert an analog display signal outputted from the voltage adjustment circuit into a digital signal; and a data driving circuit configured to generate a data voltage signal based on the digital signal obtained by the ADC circuit.

In a second aspect of the embodiments of the present disclosure, a display apparatus is provided. The display apparatus comprises the above display driving system.

DETAILED DESCRIPTION OF THE EMBODIMENTS

In the following, the embodiments of the present disclosure will be described in further detail with reference to the figures. It is to be noted that the embodiments described below are illustrative only, rather than limiting the scope of the present disclosure.

According to an embodiment of the present disclosure, a display driving system is provided. The display driving system comprises: a voltage adjustment circuit comprising an analog display signal input terminal, a trigger signal input terminal and an analog display signal output terminal. The voltage adjustment circuit is configured to adjust a blue voltage signal inputted to the analog display signal input terminal, in response to an adjustment trigger signal inputted to the trigger signal input terminal, to lower a light emission brightness corresponding to the blue voltage signal, and output the adjusted blue voltage signal via the analog display signal output terminal.

In the display driving system, the adjustment trigger signal is inputted to the trigger signal input terminal and the blue voltage signal inputted to the analog display signal input terminal is adjusted, such that the blue voltage signal outputted from the analog display signal output terminal has a reduced amplitude, thereby protecting eyes by controlling the intensity of blue light in a displayed picture.

In order to illustrate the solutions according to the present disclosure more clearly, the embodiments will be explained in detail below.

Figure 1:
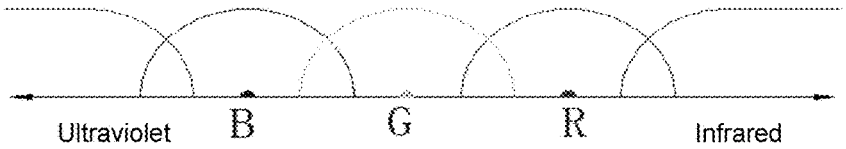
FIG. 1 is a schematic diagram showing spectra of light.
Figure 2:
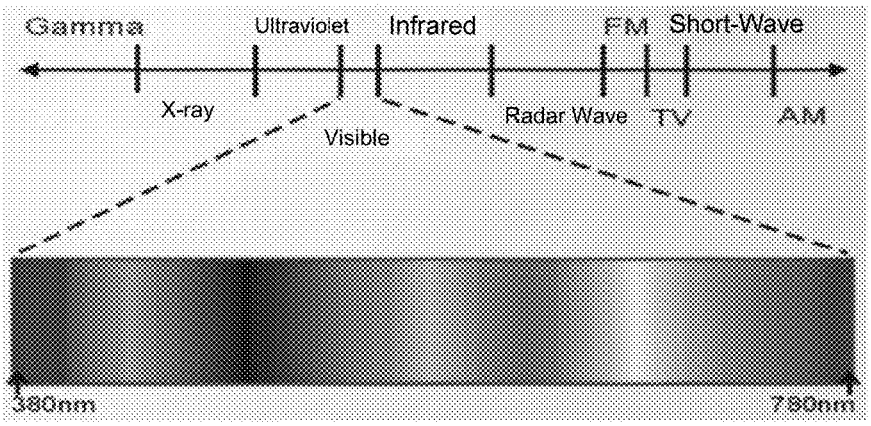
FIG. 2 is a schematic diagram showing RGB spectra.
Figure 3:
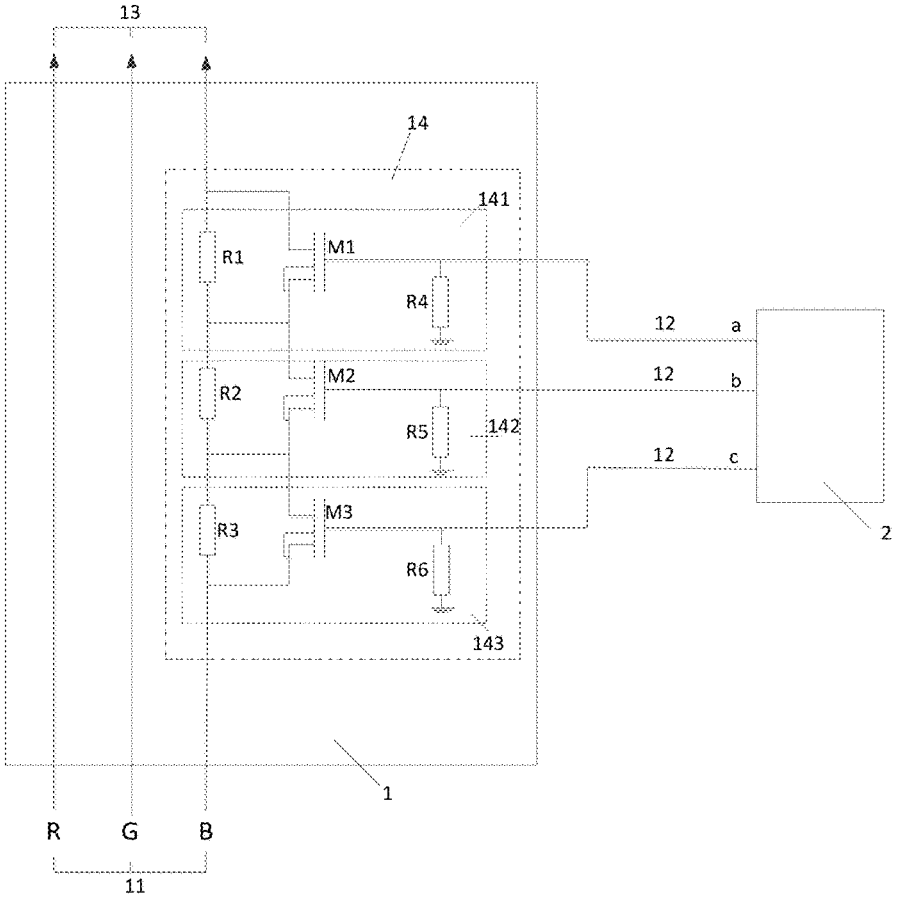
FIG. 3 is a schematic diagram showing a structure of a display driving system according to an embodiment of the present disclosure.

FIG. 3 is a schematic diagram showing a structure of a display driving system according to an embodiment of the present disclosure. As shown in FIG. 3, the display driving system includes a voltage adjustment circuit 1 including an analog display signal input terminal 11, a trigger signal input terminal 12 and an analog display signal output terminal 13. The voltage adjustment circuit 1 is configured to adjust a blue voltage signal inputted to the analog display signal input terminal 11, in response to an adjustment trigger signal inputted to the trigger signal input terminal 12, to lower a light emission brightness corresponding to the blue voltage signal, and output the adjusted blue voltage signal via the analog display signal output terminal 13.

The display driving system can adjust the blue voltage signal to be inputted to the display screen. In particular, the analog display signal input terminal 11 includes a red voltage signal input terminal R, a yellow voltage signal input terminal G and a blue voltage signal input terminal B. This embodiment mainly adjusts a blue voltage signal inputted at the blue voltage signal input terminal B.

The above display driving system further includes an adjustment switch 2 connected to the voltage adjustment circuit 1 and adapted to output, when triggered by a user, the adjustment trigger signal to the trigger signal input terminal 12 of the voltage adjustment circuit 1. When triggered, the adjustment switch 2 outputs the adjustment trigger signal triggered by the user to the trigger signal input terminal 12 of the voltage adjustment circuit 1.

The display driving system according to this embodiment can adjust the light emission intensity corresponding to the blue voltage signal depending on the user's requirement or ambient light. The above voltage adjustment circuit 1 can include a plurality of trigger signal input terminals 12 each connected to the adjustment switch 2. Accordingly, the adjustment switch 2 can adjust the blue voltage signal inputted to the analog display signal input terminal, in response to respective adjustment trigger signals inputted to the respective trigger signal input terminals, to lower the light emission brightness corresponding to the blue voltage signal by respective ratios.

It can be appreciated by those skilled in the art that, no matter how the structures of the voltage adjustment circuit 1 and the adjustment switch 2 are designed, as long as the adjustment switch 2 outputs the adjustment trigger signal to one of the trigger signal input terminals 12, the voltage adjustment circuit 1 can adjust the blue voltage signal at the analog display signal input terminal 11 in response to the adjustment trigger signal to lower the light emission brightness corresponding to the blue voltage signal. Any solutions for such purpose are to be encompassed by the scope of the present disclosure.

Moreover, while not shown in FIG. 3, the display driving system can further include an Analog-to-Digital Converter (ADC) circuit and a data driving circuit. The ADC circuit is configured to convert an analog display signal outputted from the voltage adjustment circuit 1 of the display driving system into a digital signal. The data driving circuit is configured to generate a data voltage signal based on the digital signal obtained by the above ADC circuit. Accordingly, the display driving system in this embodiment inputs the analog signal to a display screen of its display apparatus, such that the display screen of the display apparatus can output a picture.

An example of the structure of the above voltage adjustment circuit 1 is given below.

Referring to FIG. 3, the above voltage adjustment circuit 1 can include at least one adjustment unit 14 connected in series between the analog display signal input terminal 11 and the analog display signal output terminal 13 corresponding to the blue voltage signal. The number of the adjustment units 14 equals the number of the trigger signal input terminals 12 and each of the adjustment units 14 corresponds to one of the trigger signal input terminals 12. Each of the adjustment units 14 includes a resistor and a control switch connected in parallel to the resistor. The control switch has a control terminal connected to the corresponding trigger signal input terminal. For example, only three adjustment units 4 are shown in FIG. 3 for the purpose of illustration. Here, a first adjustment unit 141 includes a resistor R1 and a control switch M1 connected in parallel to the resistor R1. A second adjustment unit 142 includes a resistor R2 and a control switch M2 connected in parallel to the resistor R2. A third adjustment unit 143 includes a resistor R3 and a control switch M3 connected in parallel to the resistor R3. Each control switch has a control terminal (i.e., a gate of a transistor) connected to its corresponding trigger signal input terminal. With signals inputted to the control switches connected to the respective trigger signal input terminals, the control switches are controlled to be turned on or off, thereby controlling the number of resistors the blue voltage signal passes between the analog display signal input terminal 11 and the analog display signal output terminal 13 and thus the resistance values of the resistors the blue voltage signal passes between the analog display signal input terminal 11 and the analog display signal output terminal 13. In this way, the passing of the blue light can be reduced to various extents.

The control switches M1, M2 and M3 in the adjustment unit 14 can be switching devices such as P-type transistors or N-type transistors. In this embodiment, they are assumed to be P-type transistors, which are turned on at a low level, as an example. The above voltage adjustment circuit 1 can further include at least one ground resistor. In order to ensure the stability of the voltage at each trigger signal input terminal, each adjustment unit is provided with a ground resistor, e.g., R4, R5 and R6 as shown in FIG. 3. Each ground resistor has one end connected to the trigger signal input terminal in its corresponding adjustment unit, and the other end to the DC low voltage terminal in the system. Since there is a capacitance in each control switch connected to the ground resistor, when the signal at the trigger signal input terminal of the adjustment unit is at a high level, a portion of the voltage will be stored in the corresponding control switch. Due to the presence of the voltage, when the adjustment unit receives the signal at the trigger signal input terminal next time, it has a lower sensitivity. With the ground resistors, after the signal at the trigger signal input terminal of the corresponding adjustment unit becomes a high level signal, the control switches connected to the ground resistors will be discharged, the sensitivities of the control switches can be improved and the switching-off delay of the control switches can be avoided.

Alternatively, the adjustment unit 14 in the above voltage adjustment circuit 1 can be replaced with a variable resistor. The adjustment switch 2 can be an adjustment knob or an adjustment level button, with which the resistance value of the variable resistor can be adjusted, so as to reduce the passing of the blue light to various extents.

With reference to the above exemplary structure of the display driving system, its operation principles will be explained in detail below.

The display driving system in this embodiment can adjust the blue voltage signal at various levels, e.g., to achieve a block rate of 0, 30%, 60% or 90% for blue light. As shown in FIG. 3, for the purpose of illustration, the resistors in the respective adjustment units 14 have e.g., the same resistance value. When the user inputs trigger signals, e.g., all at the high level, to the trigger signal input terminals a, b and c, respectively, via the adjustment switch 2, the control switches M1, M2 and M3 are off. In this case, the value of the resistance the blue voltage signal passes between the analog display signal input terminal 11 and the analog display signal output terminal 13 is the resistance of R1, R2 and R3 in series, such that the intensity of the blue voltage signal inputted to blue voltage signal sub-pixels in TFT elements of an LCD panel can be controlled and the blue light can be blocked to the maximum level, with a blocking rate of approximately 90%. As another example, a low level signal can be inputted to the terminal a and a high level signal can be inputted to each of the terminals b and c. In this case, the control switch M1 is on and the control switches M2 and M3 are off. The value of the resistance the blue voltage signal passes between the analog display signal input terminal 11 and the analog display signal output terminal 13 is the resistance of R2 and R3 in series, with a blocking rate of approximately 60%. When the user wants the display screen to display pictures normally without attenuating blue light, e.g., a low level signal can be inputted to each of the terminals a, b and c. In this case, the control switches M1, M2 and M3 are all on, and the value of the resistance the blue voltage signal passes between the analog display signal input terminal 11 and the analog display signal output terminal 13 is zero, with no blocking of the blue light, i.e., a blocking rate of approximately zero. Of course, more adjustment units can be provided to allow more levels of adjustments and the details thereof will be omitted here.

The display driving system in this embodiment can input the adjustment trigger signals to the trigger signal input terminals of the respective adjustment units 14 via the adjustment switch 2 based on the user's requirement, so as to control the intensity of the blue light on the display screen. In this way, the user can control the level at which the blue light is reduced according to his/her own will, so as to mitigate the damage the blue light may cause to his/her eyes.

An another embodiment differs from the above embodiment in that, instead of the adjustment switch 2 connected to the trigger signal input terminals 12, a light sensing unit 3 inputs the adjustment trigger signals to the trigger signal input terminals 12, so as to adjust the blue voltage signal inputted to the analog display signal input terminal 11 to lower the light emission brightness corresponding to the blue voltage signal and output the adjusted blue voltage signal via the analog display signal output terminal 13.

The light sensing unit 3 is configured to determine whether an intensity of ambient light reaches an adjustment threshold, and if so, output adjustment trigger signals to the trigger signal input terminals of the voltage adjustment circuit 1, such that the voltage adjustment circuit 1 can adjust the blue voltage signal inputted to the analog display signal input terminal in response to the received adjustment trigger signals to control the intensity of blue light on the display screen. In this way, the damage caused by the blue light can be mitigated while the user is viewing information on the display screen, thereby protecting the user's eyes.

In the following, the structure of the light sensing unit 3 in this embodiment will be explained in detail.

Figure 4:
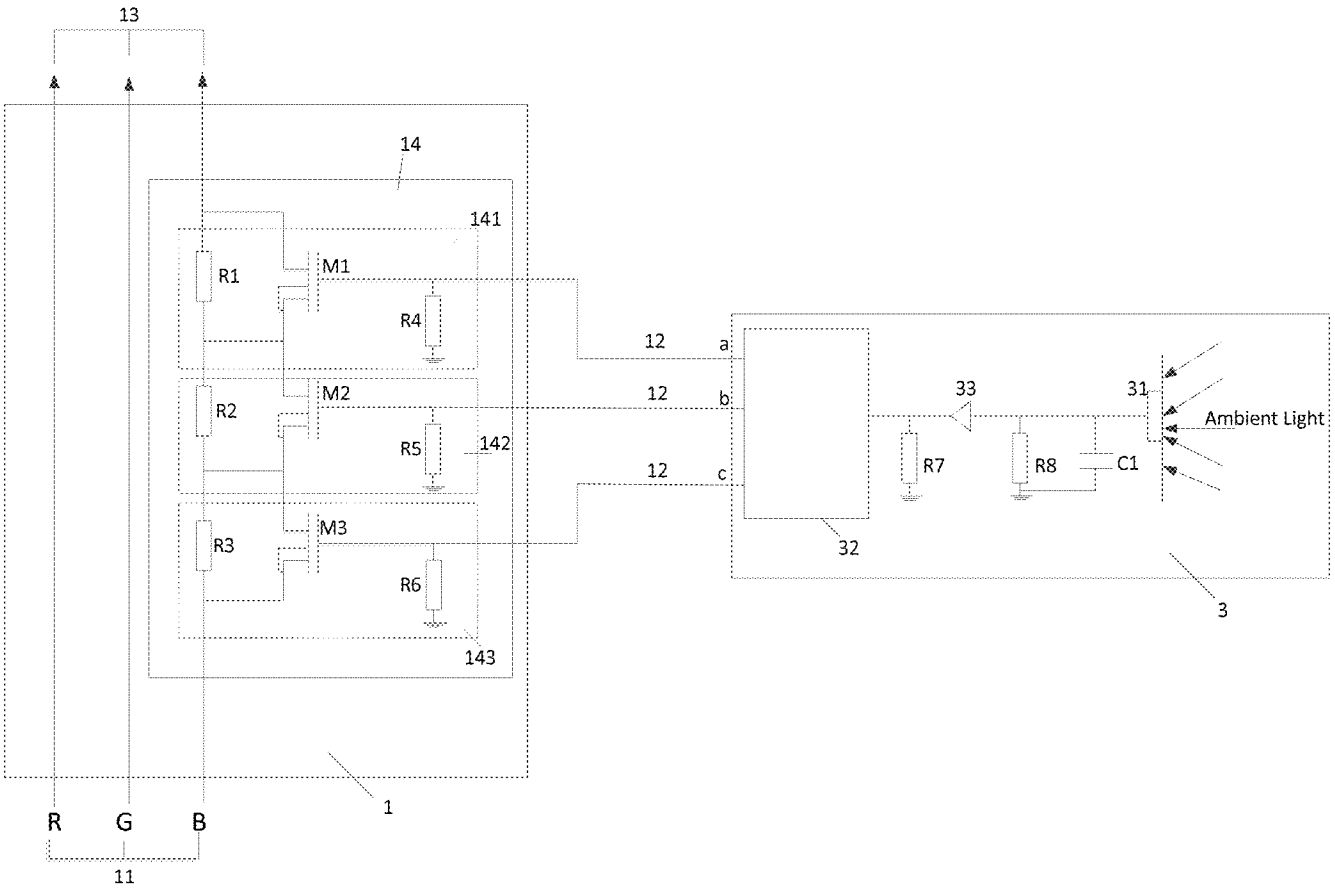
FIG. 4 is a schematic diagram showing a structure of a display driving system according to another embodiment of the present disclosure.

As shown in FIG. 4, the light sensing unit 3 may include a light sensor 31, a logic circuit 32 and an amplifier 33.

The logic circuit 32 included in the light sensing unit 3 is configured to generate adjustment trigger signals based on a light intensity signal collected by the light sensor 31, and output the adjustment trigger signals to the trigger signal input terminals 12 in the voltage adjustment circuit 1 for controlling the intensity of the blue light on the display screen.

Of course, the ambient light in this embodiment can be e.g., strong or weak light in daytime or light at night. The adjustment trigger signals can be outputted to the trigger signal input terminals 12 (e.g., the terminals a, b and c shown in FIG. 4) in the above voltage adjustment circuit 1. In this case, it is required that the voltage adjustment circuit 1 includes a plurality of trigger signal input terminals. When the intensity of the ambient light reaches different adjustment thresholds, the light sensing unit 3 outputs the adjustment trigger signals to the respective trigger signal input terminals of the voltage adjustment circuit, so as to adjust the blue voltage signal at different levels depending on different intensities of the ambient light.

The amplifier 33 in the light sensing unit 3 is configured to amplify the light intensity signal collected by the light sensor 31. The logic circuit 32 is configured to generate the adjustment trigger signals based on the amplified light intensity signal. With the amplifier 33 provided between the light sensor 31 and the logic circuit 32, the Signal-to-Noise Ratio (SNR) of the light intensity signal can be increased and thus the accuracy of determination by the logic circuit 32 can be improved.

Further, a ground resistor R7 can be provided between the amplifier 33 and the logic circuit 32, and a ground resistor R8 and a filter capacitor C1 can be provided between the amplifier 33 and the light sensor 31. The capacitance value of the filter capacitor C1 can be e.g., 0.001 uf. The filter capacitor C1 and the ground resistor R8 has a filtering function for filtering out an interference signal caused by the ambient light introduced by the light sensor 31 to the blue light to be sensed. The ground resistor R7 has a charging function to improve the real-time feature of the light intensity signal outputted from the amplifier 33.

In this embodiment, the light sensor 31 in the light sensing unit 3 senses the intensity of the ambient light, and the logic circuit 32 inputs the adjustment trigger signals to the respective trigger signal input terminals 12 of the adjustment unit 14 based on the sensed intensity of the ambient light, for controlling the intensity of the blue light on the display screen. Therefore, the passing of the blue light can be controlled automatically based on the ambient light, such that the damage caused by the blue light can be mitigated and the user's eyes can be protected while making it more comfortable for the user to view the display screen for a long time.

The operation principles of the display driving system in this embodiment are similar to those described in connection with the above embodiment. However, unlike the above embodiment in which the intensity of the blue light is adjusted in accordance with the user's requirement, this embodiment allows automatic adjustment of the intensity of the blue light based on the intensity of the ambient light. For example, at night a human's pupil becomes larger to identify environment information in the dark. If the user views the display screen for a long time at night, there would be more blue light and ultraviolet light entering his/her eyes, causing even more damages. Thus, compared with the situation with strong light in daytime, it is required to limit the passing of the blue light to a lower level, i.e., to block more blue light. That is, the logic circuit 32 can input trigger signals, e.g., all at the high level, to the trigger signal input terminals a, b and c, respectively, such that the control switches M1, M2 and M3 are off. In this case, the value of the resistance the blue voltage signal passes between the analog display signal input terminal 11 and the analog display signal output terminal 13 is the resistance of R1, R2 and R3 in series, such that the intensity of the blue voltage signal inputted to blue voltage signal sub-pixels in TFT elements of an LCD panel can be controlled and the blue light can be blocked to the maximum level, with a blocking rate of approximately 90%. In contrast, in the situation with strong light in daytime, the passing of the blue light can be controlled more moderately. For example, a low level signal can be inputted to each of the terminals a and b and a high level signal can be inputted to the terminal c. In this case, the control switches M1 and M2 are on and the control switch M3 is off. The value of the resistance the blue voltage signal passes between the analog display signal input terminal 11 and the analog display signal output terminal 13 is the resistance of R3, with a blocking rate of approximately 30%. As for how to control the reduction of output of the blue light based on the intensity of the ambient light, it can be configured at the logic circuit 32 in accordance with the user's requirement, e.g., a logic correspondence between the intensities of the ambient light and the trigger signals to be inputted can be set in the logic circuit 32, and the details thereof will be omitted here.

As described above, the intensity of the blue light can be adjusted based on the user's requirement as in the first embodiment, or automatically based on the intensity of the ambient light as in the second embodiment. When the above display driving system is required to be capable of adjusting the intensity of the blue light based on the user's requirement and also automatically based on the intensity of the ambient light, an additional adjustment switch can be added as shown in FIG. 4. The additional adjustment switch can be configured to have the same structure as the adjustment switch 2 shown in FIG. 3. The additional adjustment switch and the light sensing unit 3 can both be connected to the trigger signal input terminal 12 in the voltage adjustment circuit 1.

Further, in order to switch between the user's manual adjustment of the intensity of the blue light or the automatic adjustment of the intensity of the blue light based on the intensity of the ambient light, the above display driving system can further include a switching element. With the switching element, the intensity of the blue light can be adjusted based on the user's requirement or automatically based on the intensity of the ambient light. Of course, this embodiment is provided for the purpose of illustration only, without limiting its specific implementations.

According to an embodiment of the present disclosure, a display apparatus is provided. The display apparatus includes the above display driving system.

According to the embodiments of the present disclosure, the display screen in the display apparatus including the above display driving system has a lower cost, is more convenient to use, and has a wider range of applications, when compared with the conventional techniques in which a filter is added to filter out the blue light.

The display apparatus in this embodiment can be an e-book, a mobile phone, a tablet computer, a television, a notebook computer, a digital frame, a navigator or any other product or component having a display function.

Many details have been given in the description of the embodiments according to the present disclosure. However, it can be appreciated that the embodiments according to the present disclosure can be implemented without these details. In some examples, details of known methods, structures and techniques have been omitted, so as not to obscure the concept of the present disclosure.

The scientific or technical terms used herein have the meaning that is commonly understood by those having ordinary skills in the art. The terms such as "first", "second" and the like as used herein are not intended to imply any sequence, number or importance, but only for distinguishing among different components. Likewise, the terms such as "a", "an", "the" and the like do not imply any limitation to number, but indicate the presence of at least one. Terms such as "comprise", "include" and the like mean that the element preceding the term contains the elements following the term or equivalents thereof, but do not exclude other elements. Terms such as "connected to", "connected with" or the like do not necessarily refer to a physical or mechanical connection, but also include an electrical connection, either directly or indirectly. The terms such as "above", "below", "left" and "right" only indicate a relative position. When the absolute position of the object concerned has changed, the relative position may change accordingly.

The embodiments described above are provided for illustrating, rather than limiting, the solutions of the present disclosure. While the present disclosure has been explained in detail with reference to the above embodiments, it should be appreciated by those skilled in the art that various modifications can be made to the solutions according the above embodiments, or various equivalent alternatives can be made to part or all technical features thereof, without departing from the spirit and scope of the present disclosure. All these modifications and alternatives are to be encompassed by the scope of the present disclosure.

What is claimed is:

1. A display driving system, comprising:

a voltage adjustment circuit comprising an analog display signal input terminal, a trigger signal input terminal and an analog display signal output terminal, wherein the voltage adjustment circuit is configured to adjust a blue voltage signal inputted to the analog display signal input terminal, in response to an adjustment trigger signal inputted to the trigger signal input terminal, to lower a light emission brightness corresponding to the blue voltage signal, and output the adjusted blue voltage signal via the analog display signal output terminal.

2. The system of claim 1, wherein the voltage adjustment circuit comprises a plurality of trigger signal input terminals and is adapted to adjust the blue voltage signal inputted to the analog display signal input terminal, in response to respective adjustment trigger signals inputted to the respective trigger signal input terminals, to lower the light emission brightness corresponding to the blue voltage signal by respective different ratios.

3. The system of claim 2, further comprising: an adjustment switch connected to the voltage adjustment circuit and adapted to output, when triggered by a user, the adjustment trigger signal(s) to the trigger signal input terminal(s) of the voltage adjustment circuit.

4. The system of claim 3, wherein the voltage adjustment circuit comprises a plurality of trigger signal input terminals, and the adjustment switch is configured to output the respective adjustment trigger signals to the respective trigger signal input terminals of the voltage adjustment circuit in response to a trigger instruction from the user.

5. The system of claim 2, further comprising: a light sensing unit adapted to determine whether an intensity of ambient light reaches an adjustment threshold and, if so, output the adjustment trigger signal(s) to the trigger signal input terminal(s) of the voltage adjustment circuit.

6. The system of claim 5, wherein the voltage adjustment circuit comprises a plurality of trigger signal input terminals, and the light sensing unit is configured to output the respective adjustment trigger signals to the respective trigger signal input terminals of the voltage adjustment circuit when the intensity of the ambient light reaches respective different adjustment thresholds.

7. The system of claim 5, wherein the light sensing unit comprises a light sensor and a logic circuit configured to generate the adjustment trigger signal(s) based on a light intensity signal collected by the light sensor.

8. The system of claim 2, wherein the voltage adjustment circuit comprises at least one adjustment unit connected in series between the analog display signal input terminal and the analog display signal output terminal corresponding to the blue voltage signal, the number of the adjustment units equals the number of the trigger signal input terminals and each of the adjustment units corresponds to one of the trigger signal input terminals, and each of the adjustment units comprises a resistor and a control switch connected in parallel to the resistor, the control switch having a control terminal connected to the corresponding trigger signal input terminal.

9. A display apparatus, comprising the display driving system according to claim 2.

10. The system of claim 1, further comprising: an adjustment switch connected to the voltage adjustment circuit and adapted to output, when triggered by a user, the adjustment trigger signal(s) to the trigger signal input terminal(s) of the voltage adjustment circuit.

11. The system of claim 10, wherein the voltage adjustment circuit comprises a plurality of trigger signal input terminals, and the adjustment switch is configured to output the respective adjustment trigger signals to the respective trigger signal input terminals of the voltage adjustment circuit in response to a trigger instruction from the user.

12. A display apparatus, comprising the display driving system according to claim 10.

13. The system of claim 1, further comprising: a light sensing unit configured to determine whether an intensity of ambient light reaches an adjustment threshold and, output the adjustment trigger signal(s) to the trigger signal input terminal(s) of the voltage adjustment circuit in response to the intensity of ambient light reaching the adjustment threshold.

14. The system of claim 13, wherein the voltage adjustment circuit comprises a plurality of trigger signal input terminals, and wherein the light sensing unit is configured to output a plurality of adjustment trigger signals to the plurality of trigger signal input terminals of the voltage adjustment circuit respectively in response to the intensity of the ambient light reaching respective different adjustment thresholds.

15. The system of claim 13, wherein the light sensing unit comprises a light sensor and a logic circuit configured to generate the adjustment trigger signal(s) based on a light intensity signal collected by the light sensor.

16. The system of claim 15, wherein the light sensing unit further includes an amplifier configured to amplify the light intensity signal collected by the light sensor, and the logic circuit is configured to generate the adjustment trigger signal(s) based on the amplified light intensity signal.

17. The system of claim 15, further comprising a Direct Circuit (DC) low voltage terminal, wherein the voltage adjustment circuit further comprises at least one ground resistor having one end connected to the DC low voltage terminal and the other end to one trigger signal input terminal.

18. The system of claim 1, wherein the voltage adjustment circuit comprises at least one adjustment unit connected in series between the analog display signal input terminal and the analog display signal output terminal corresponding to the blue voltage signal, the number of the adjustment units equals the number of the trigger signal input terminals and each of the adjustment units corresponds to one of the trigger signal input terminals, and each of the adjustment units comprises a resistor and a control switch connected in parallel to the resistor, the control switch having a control terminal connected to the corresponding trigger signal input terminal.

19. A display apparatus, comprising the display driving system according to claim 1.

* * * * *